US006398521B1

(12) United States Patent
Yorulmazoglu

(10) Patent No.: US 6,398,521 B1
(45) Date of Patent: Jun. 4, 2002

(54) ADAPTER FOR MOTOR AND FLUID PUMP

(75) Inventor: Idil Yorulmazoglu, Shorewood, WI (US)

(73) Assignee: Sta-Rite Industries, Inc., Milwaukee, WI (US)

( * ) Notice: Subject to any disclaimer, the term of this patent is extended or adjusted under 35 U.S.C. 154(b) by 0 days.

(21) Appl. No.: 09/772,738

(22) Filed: Jan. 30, 2001

(51) Int. Cl.[7] ..... F04B 17/00; F16B 7/00

(52) U.S. Cl. ..... 417/360; 417/423.6; 403/298

(58) Field of Search ..... 417/360, 423.6; 464/182, 170; 403/298, 359.1; 74/609

(56) References Cited

U.S. PATENT DOCUMENTS

| | | | | | |
|---|---|---|---|---|---|
| 2,380,952 | A | | 8/1945 | Dewey | 464/182 |
| 2,587,838 | A | | 3/1952 | Green | 403/359.1 |
| 3,404,363 | A | | 10/1968 | Fischer | 439/279 |
| 3,555,319 | A | | 1/1971 | Schaefer | 310/87 |
| 3,582,116 | A | | 6/1971 | Young | 287/53 |
| 3,610,781 | A | * | 10/1971 | Kolb et al. | 417/360 |
| 3,688,140 | A | | 8/1972 | Schaefer | 310/87 |
| 3,717,421 | A | | 2/1973 | Schaefer | 417/38 |
| 3,761,750 | A | | 9/1973 | Green | 310/87 |
| 3,777,194 | A | | 12/1973 | Schaefer et al. | 310/87 |
| 3,782,858 | A | | 1/1974 | Deters | 417/26 |
| 3,837,612 | A | | 9/1974 | Deters | 249/105 |
| 3,842,298 | A | | 10/1974 | Schaefer | 310/87 |
| 3,990,550 | A | | 11/1976 | Recker | 192/46 |
| 4,042,847 | A | | 8/1977 | Jensen | 310/87 |
| 4,289,988 | A | | 9/1981 | Schaefer | 310/68 |
| 4,292,555 | A | | 9/1981 | Schaefer | 310/68 |
| 4,336,473 | A | | 6/1982 | Wetters et al. | 310/88 |
| 4,473,359 | A | * | 9/1984 | Davis | 464/88 |
| 4,597,555 | A | | 7/1986 | Weihsmann | 248/672 |
| 4,747,796 | A | | 5/1988 | Iwai et al. | 440/83 |
| 4,780,953 | A | | 11/1988 | Wheeler et al. | 29/596 |
| 4,819,402 | A | | 4/1989 | Schneider | 52/726 |
| 4,832,637 | A | | 5/1989 | Goluba | 440/83 |
| 4,918,802 | A | | 4/1990 | Schaefer | 29/598 |
| 4,930,996 | A | | 6/1990 | Jensen et al. | 417/373 |
| 4,967,303 | A | | 10/1990 | Yuhasz | 361/23 |
| 4,981,420 | A | | 1/1991 | Jensen et al. | 417/423.3 |
| 5,028,218 | A | | 7/1991 | Jensen et al. | 417/423.3 |
| 5,112,259 | A | | 5/1992 | McElroy, Jr. et al. | 440/83 |
| 5,333,963 | A | * | 8/1994 | Blumentrath | 403/301 |
| 5,435,073 | A | * | 7/1995 | Sullivan | 33/661 |
| 5,558,456 | A | | 9/1996 | Nakase et al. | 403/359 |
| 5,704,717 | A | | 1/1998 | Cochimin | 384/215 |
| 5,714,816 | A | | 2/1998 | Jensen et al. | 310/89 |
| 5,716,156 | A | | 2/1998 | Bayer et al. | 403/282 |
| 5,796,197 | A | | 8/1998 | Bookout | 310/85 |
| 5,868,175 | A | | 2/1999 | Duff et al. | 141/59 |
| 5,868,517 | A | | 2/1999 | Aoki et al. | 403/359 |
| 5,898,245 | A | | 4/1999 | Cochimin | 310/52 |
| 5,941,695 | A | | 8/1999 | Jensen et al. | 417/423.3 |
| 6,022,196 | A | | 2/2000 | Jensen et al. | 417/44.1 |
| 6,129,529 | A | * | 10/2000 | Young et al. | 417/423.3 |
| 6,257,985 | B1 | * | 7/2001 | Ward et al. | 464/80 |

OTHER PUBLICATIONS

Photographs of product understood to be available from Marwan Tasabihji Company, Damascus, Syria, 5 pages (Photographs taken on or about Jan. 2001).

* cited by examiner

*Primary Examiner*—Charles G. Freay
*Assistant Examiner*—Michael K. Gray
(74) *Attorney, Agent, or Firm*—Foley & Lardner

(57) ABSTRACT

An adapter for coupling a motor to a pump includes a collar having a first end being removably coupled to a motor housing and a second end being removably coupled to a pump housing of differing size. The collar forms an internal cavity. The drive coupler further includes a drive coupler disposed within the internal cavity, coaxially aligned with the collar. The adapter further includes a motor shaft portion on the drive coupler being configured to engage a motor shaft on a first end, and being configured to engage a pump shaft on a second end. The drive coupler is configured to engage a motor shaft and pump shaft of differing diameters.

59 Claims, 5 Drawing Sheets

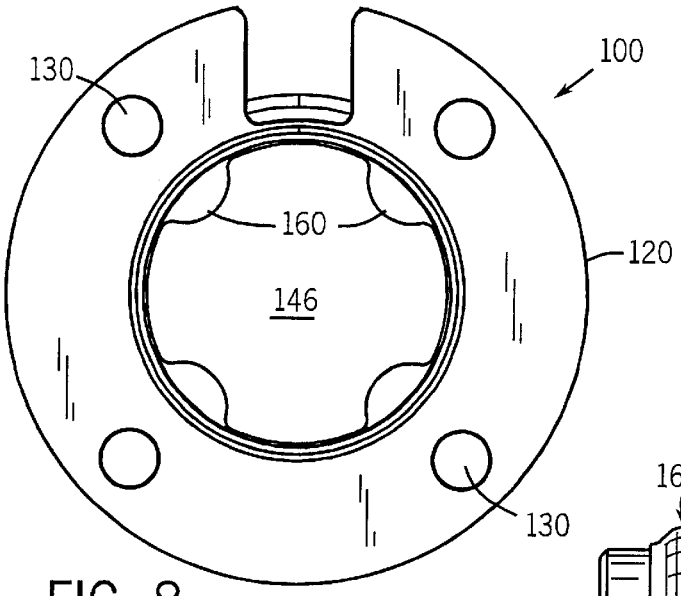
FIG. 8
FIG. 7
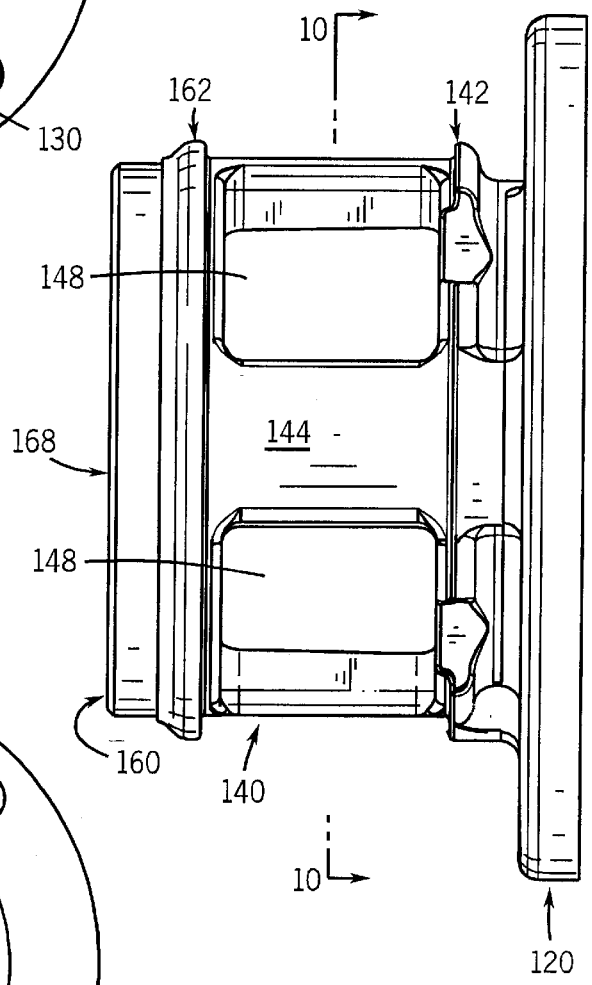
FIG. 9
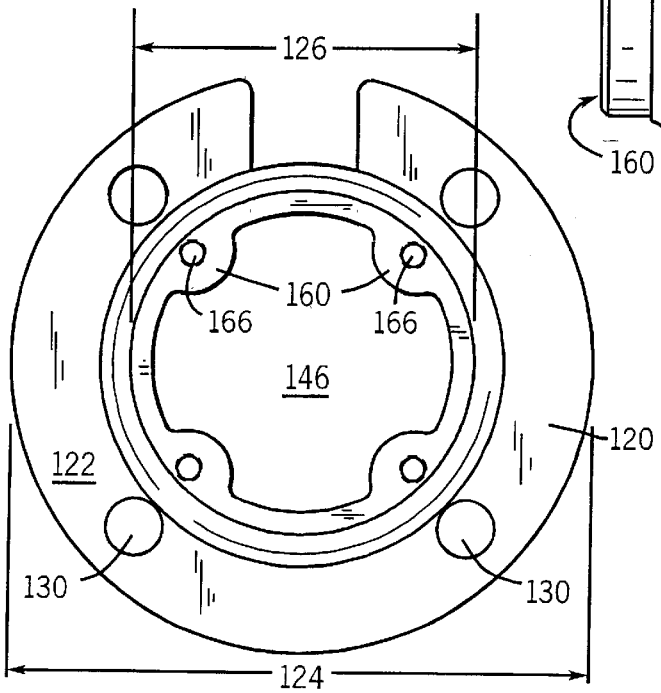

FIG. 11
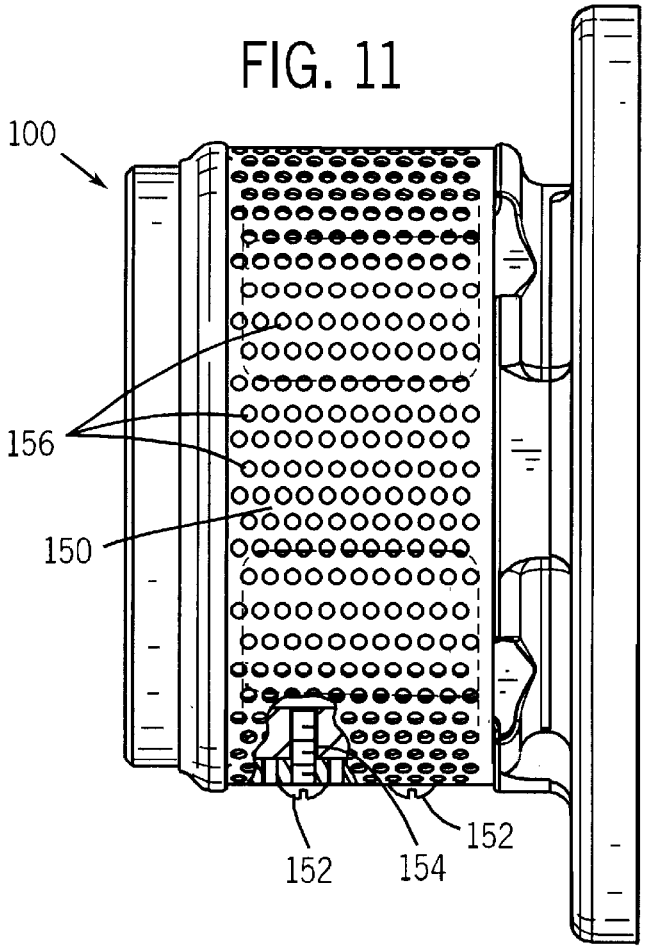
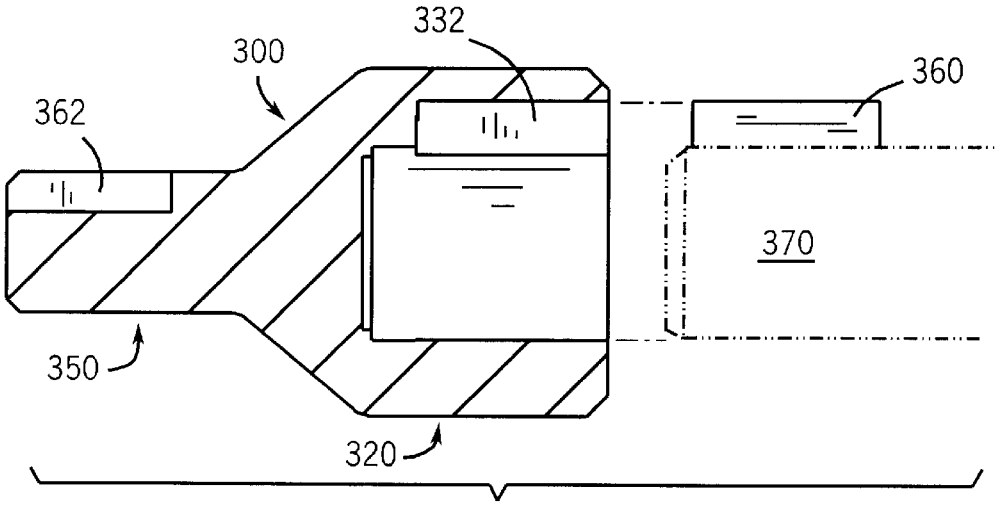
FIG. 12

ADAPTER FOR MOTOR AND FLUID PUMP

FIELD OF THE INVENTION

The present invention relates generally to submersible motors and fluid pumps. More specifically, the present invention relates to an apparatus and method of removably coupling and adapting a motor to a fluid pump of differing size.

BACKGROUND OF THE INVENTION

It is generally known in the fluid handling arts to provide a fluid pump driven by a motor in order to effect the bulk transfer of fluid. Such fluid handling systems are used in industrial, commercial and residential applications such as mining, oil field exploration, turf and agricultural irrigation, municipal water handling systems, fountains, golf courses, sump pumps, etc. Typically, both the pump and motor used in these systems are submersed in the fluid to be pumped.

A typical fluid handling system may utilize what is known in the art as a 4" pump driven by what is known in the art as a 4" motor. A 4" pump may be desirable in many situations, and suited to fit operational requirements (e.g. high pressure output, cost constraints, size constraints, etc.). Similarly, other fluid pumping systems may utilize what is known in the art as a 6" pump driven by what is known in the art as a 6" motor in situations where the 6" pump is more suited to fit other operational requirements (e.g. higher fluid flow rates, improved ability to handle sand and debris, power requirements, etc.).

These systems typically connect the pump to the motor by a "direct-mount" connection (e.g. bolting the pump and motor bodies directly to each other, the pump and motor bodies being a one piece construction, etc.). Such systems typically include a motor shaft powered in rotation by the motor. The motor shaft rotation is used to drive various stages of impellers within the pump module by engaging the pump shaft. The motor shaft directly engages the pump shaft with an engagement portion formed on the motor shaft. In these typical configurations, the motor shaft is directly coupled to the pump shaft.

Such systems have several disadvantages. One such disadvantage is some systems which employ a direct connection between the motor shaft and the pump shaft may experience failures including shaft breakage or shaft failure. One possible reason for the shaft failure is the motor will not always output a constant level of torque to the pump shaft. The motor may rapidly change the torque output, thereby transmitting a spike or impulse of torque to the pump shaft. These transmitted spikes or impulses of torque can result in damaging and perhaps breaking the pump shaft.

Other typical systems engage the motor shaft to the pump shaft with an intervening two-piece coupling. In these systems, a male portion of the motor shaft engages an outer sleeve, the first piece of the two-piece coupling. The outer sleeve then engages an inner shaft, the second piece of the two-piece coupling. The inner shaft then engages a female socket on the pump shaft.

Such systems also have several disadvantages. One such disadvantage is systems which employ a two-piece coupling may also experience failures including shaft breakage or shaft failure. One possible reason for such failures is the two piece design introduces additional required parts. Each part has an associated machining tolerance or error. By introducing additional required parts, machining tolerances and errors are increased. Tolerances and errors result in systems with more imprecision in the parts and thereby increase failure rates. For example, machining tolerances and errors may result in an eccentricity or imbalance in the motor and pump shaft structures. The stresses placed on the motor and pump shaft structures by the imbalance increases with shaft rotation speed. The stresses caused by the imbalance may reach a high enough level to cause failure in the pump shaft.

Both the direct connection and the two-piece coupling systems have further disadvantages. Under similar operating conditions, a 6" motor will typically have a longer operational life expectancy that will a 4" motor. If a 4" motor fails, it may be desirable to keep the present pump (for reasons such as feasibility of removing pump, cost, performance characteristics of the current pump, etc.), and replace the motor with one of longer life expectancy (i.e. a 6" motor).

Both the direct connection and the two-piece coupling systems are not well suited to allow easy replacement of one motor to a motor of differing diameter without simultaneously replacing the pump as well. Furthermore, these systems are not well suited to physically adapt a new 6" motor to an existing 4" pump such that the 6" motor is capable of driving the 4" pump. Furthermore, current systems are not well suited to allow a motor and pump to be readily disconnected, and allow a user to change between various motors and pumps.

Accordingly, there is a need to provide an adapter which would allow a user to readily replace one motor to a motor of differing diameter without simultaneously replacing the pump. There is also a need to provide an adapter which would be capable of adapting a 6" motor to a 4" pump such that the 6" motor is capable of driving the 4" pump. It would be desirable to provide an adapter capable of fulfilling one or more of these or other needs.

The teachings hereinbelow extend to those embodiments which fall within the scope of the appended claims, regardless of whether they accomplish one or more of the above mentioned needs.

SUMMARY OF THE INVENTION

The present invention relates to an adapter capable of rotatably coupling a motor shaft to a pump shaft of differing diameter, thereby allowing torque which is developed in a motor to be transmitted to a pump.

The present invention also relates to an adapter capable of rigidly coupling a motor housing to a pump housing, minimizing relative movement between motor and pump and thereby reducing wear and allowing smooth torque transmission from motor to pump.

The present invention further relates to an adapter for coupling a motor to a pump having a collar, the collar being removably coupled to a motor housing and a pump housing; the motor housing and pump housing having a differing diameter. The adapter further includes a drive coupler disposed within an internal cavity formed in the collar. The drive coupler includes a socket configured to engage a motor shaft, and a shaft configured to engage a pump shaft where the motor and pump shafts are of differing diameters.

The present invention further relates to a method of adapting a motor to a pump. The method includes providing a collar being removably coupled to a motor housing and a pump housing; the motor housing and pump housing having a differing diameter. The method further includes providing a drive coupler disposed within an internal cavity formed in the collar. The drive coupler includes a socket configured to engage a motor shaft, and a shaft configured to engage a pump shaft where the motor and pump shafts are of differing diameters.

BRIEF DESCRIPTION OF THE FIGURES

FIG. 7 is a front elevation view of a collar according to an exemplary embodiment;

FIG. 8 is a right side view of the collar according to an exemplary embodiment;

FIG. 9 is a left side view of the collar according to an exemplary embodiment;

FIG. 11 is an alternative embodiment of the collar shown in FIG. 7; and

FIG. 12 is an alternative embodiment of the drive coupler shown in FIG. 6.

DETAILED DESCRIPTION OF THE PREFERRED EMBODIMENTS

Figure 1:
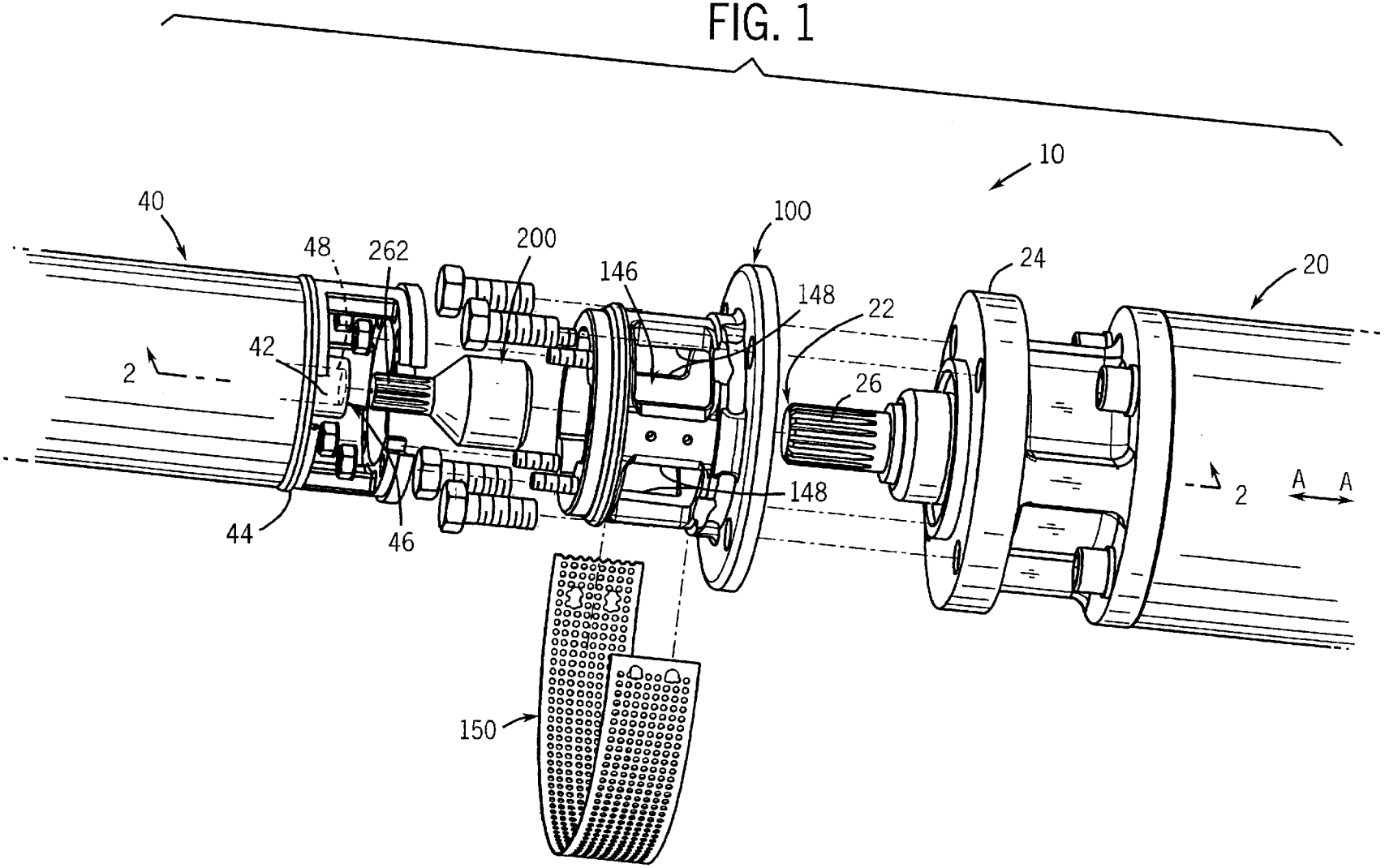
FIG. 1 is an exploded perspective view of an adapter according to an exemplary embodiment.

Shown in FIG. 1 is an exemplary embodiment of an adapter 10 in a working environment. The working environment may be a mining shaft, well, submersed in a body of fluid, etc. A motor 20 and a pump 40 are substantially aligned along shaft rotation axis, shown as major axis A—A in the working environment.

In an exemplary embodiment, motor 20 is what is known in the fluid handling arts as a 6" motor. A typical 6" motor, Part Number 226112, is available from Franklin Electric, Bluffton, Ind. A typical 6" motor is designed to fit in a 6" shaft (such as a mine shaft or well) and typically has a body diameter of approximately 5.4 inches. Alternatively, motor 20 may be what is known in the fluid handling arts as a 8" motor. A typical 8" motor, Part Number 279310, is also available from Franklin Electric, Bluffton, Ind. A typical 8" motor is designed to fit in a 8" shaft (such as a mine shaft or well) and typically has a body diameter of approximately 7.5 inches. Motor 20 includes motor shaft 22 disposed on one end of motor 20.

In an exemplary embodiment, pump 40 is what is known in the fluid handling arts as a 4" pump. A typical 4" pump, Part Number L30P4LH-03, is available from Sta-Rite Industries, Inc., Delavan, Wis. A typical 4" pump has a body diameter of approximately 3.4 inches. Alternatively, pump 40 may be what is known in the fluid handling arts as a 6" pump. A typical 6" pump, Part Number 6AL16, is available from Berkeley Pumps Inc., Delavan, Wis. A typical 6" pump has a body diameter of approximately 5.4 inches. Other examples of suitable pumps are described in U.S. Pat. No. 5,028,218 (entitled "IMMERSION PUMP ASSEMBLY") issued to Jensen et al. on Jul. 2, 1991, U.S. Pat. No. 4,981,420 (entitled "IMMERSION PUMP") issued to Jensen et al. on Jan. 1, 1991, and U.S. Pat. No. 4,930,996 (entitled "IMMERSION PUMP ASSEMBLY") issued to Jensen et al. on Jun. 5, 1990. Pump 40 includes pump shaft 42 disposed on one end of pump 40.

As shown in FIG. 1, adapter 10 is disposed between motor 20 and pump 40, adapter 10 also being substantially aligned along major axis A—A. Adapter 10 includes two components: a drive coupler 200 and a collar 100 which are used in coupling motor 20 to pump 40.

Figure 2:
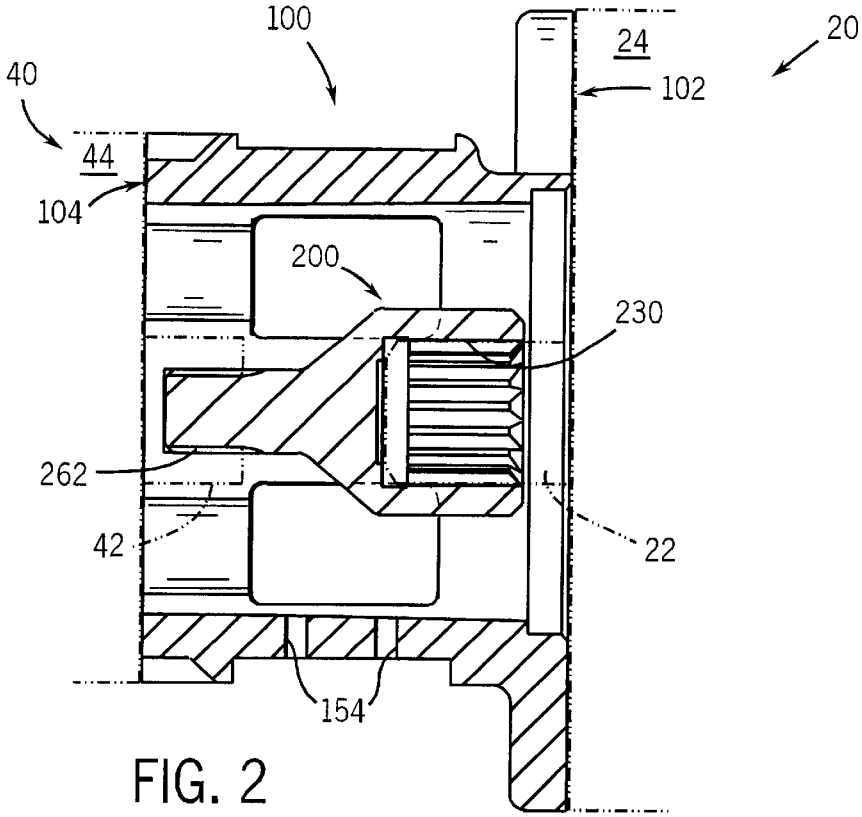
FIG. 2 is a sectional view of the adapter of FIG. 1, shown in an assembled condition, taken along line 2—2 in FIG. 1.
Figure 10:
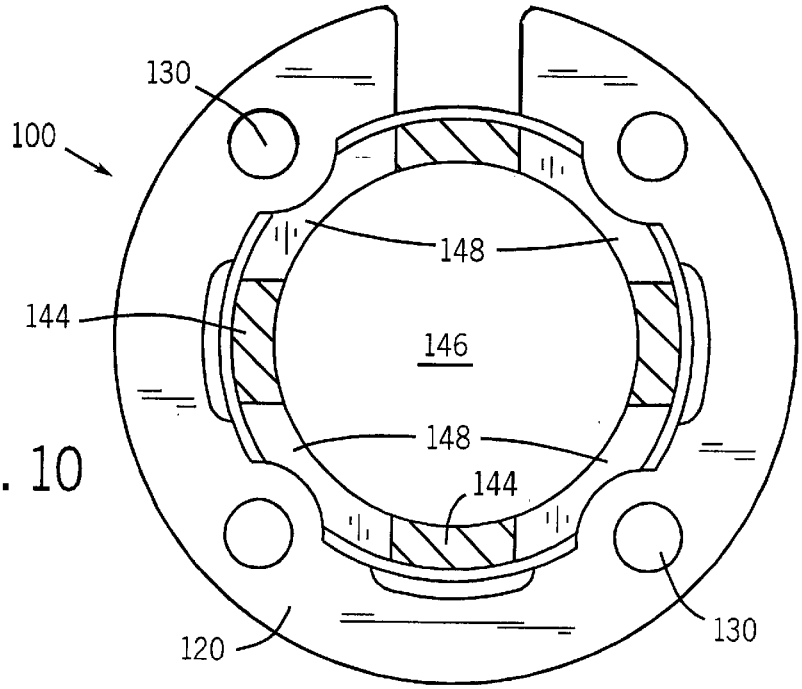
FIG. 10 is a cross-sectional view of the collar taken along line 10—10 of FIG. 7.

In an exemplary embodiment as shown in FIG. 1, motor 20 and pump 40 are substantially aligned resulting in motor shaft 22 and pump shaft 42 being aligned along the axis of shaft rotation shown as a major axis A—A. Drive coupler 200 and collar 100 are disposed between motor 20 and pump 40, on major axis A—A. As shown in FIG. 2, motor housing 24 is rigidly coupled to a first end 102 of collar 100, and pump housing 44 is rigidly coupled to a second end 104 of collar 100. Collar 100 thereby rigidly attaches motor housing 24 to pump housing 44, preventing relative motion between motor 20 and pump 40.

Referring again to FIG. 1, motor shaft 22 and pump shaft 42 are disposed in a cavity 146 formed within collar 100. Drive coupler 200 is disposed between motor shaft 22, and pump shaft 42, substantially aligned on major axis A—A within cavity 146. Drive coupler 200 engages motor shaft 22 and pump shaft 42 thereby rotatably coupling motor shaft 22 and pump shaft 42.

Figure 6:
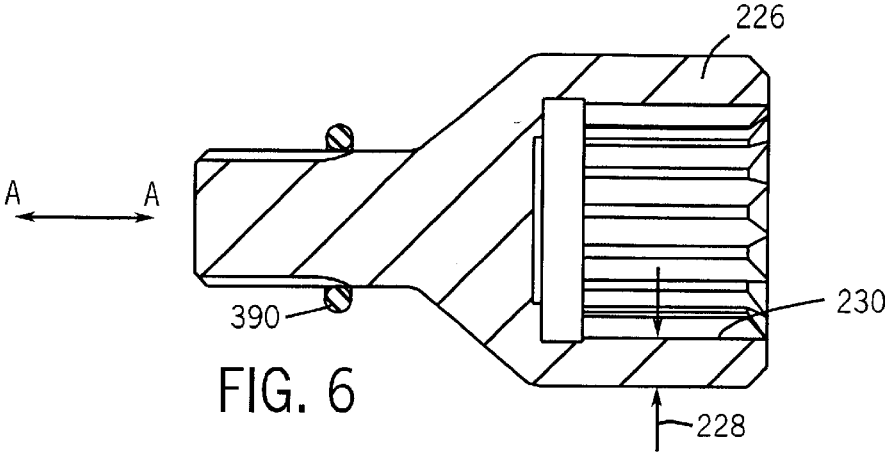
FIG. 6 is a cross-sectional view of the drive coupler taken along line 6—6 of FIG. 4.

As discussed above, adapter 10 includes drive coupler 200 as shown in FIGS. 3–6. Drive coupler 200 rotatably couples motor shaft 22 to pump shaft 42, thereby allowing torque to be transmitted from motor shaft 22 to pump shaft 42. Drive coupler 200 is configured to rotatably couple motor shaft 22 having a first diameter, to pump shaft 42 having a second diameter wherein the first diameter is greater or lesser than the second diameter. In an exemplary embodiment, the first diameter of motor shaft 22 is approximately between 0.7 and 1.10 inches, and the second diameter of pump shaft 42 is approximately between 0.4 and 0.6 inches in diameter. Alternatively, the diameters of motor shaft 22 and pump shaft 42 may be any diameter required for a specific application As shown in FIG. 6, drive coupler 200 is constructed from a unitary body. The unitary construction provides several advantages over the direct connection and two-piece coupling systems discussed above.

Adapter 10 has an advantage over the direct connection system discussed above because adapter 10 provides an intermediate connection (i.e. drive coupler 200) between motor shaft 22 and pump shaft 42. It is believed that drive coupler 200 is at least partially capable of absorbing torque spikes or impulses by elastically deforming. Elastically deforming is believed to protect pump shaft 42 from the torque spikes or impulses, thereby extending the operational life expectancy of pump shaft 42.

Furthermore, adapter 10 has an advantage over the two-piece coupling system discussed above. The unitary body construction of drive coupler 200 allows drive coupler 200 to be a shorter length, thereby allowing the overall length of adapter 10 to be shorter than the two-piece coupling system. A shorter overall length of adapter 10 results in decreased material costs. Also, a shorter length of drive coupler 200 results in drive coupler 200 having a higher torsional rigidity, higher strength and less deflection than the longer two-piece coupling. Also, a shorter length of drive coupler 200 minimizes the separation between motor 20 and pump 40. Furthermore, the unitary body construction of drive coupler 200 results in fewer machining tolerances and errors than the two-piece coupling system.

In an exemplary embodiment, drive coupler 200 is constructed from 304 stainless steel, but alternatively drive coupler 200 may be constructed from other stainless steel alloys, aluminum, brass, zinc, steel, carbon steel, composite materials including fiberglass and carbon composites, etc.

Figure 3:
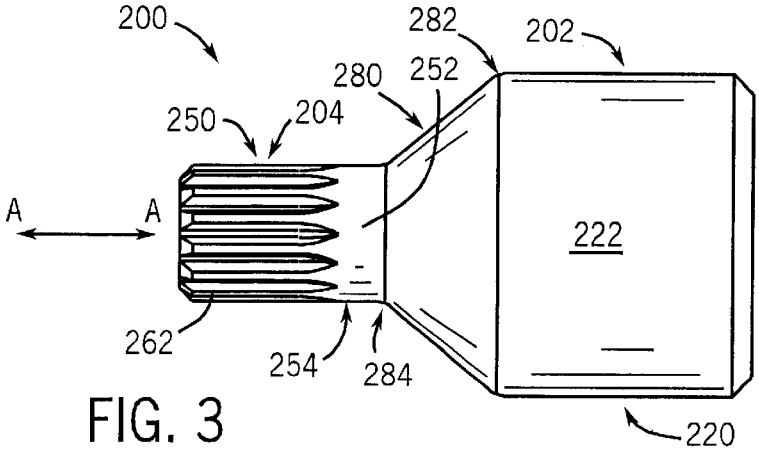
FIG. 3 is a front elevation view of a drive coupler according to an exemplary embodiment.

As shown in FIG. 3, drive coupler 200 includes a motor shaft portion 220, a pump shaft portion 250, and a reducing portion 280.

Figure 5:
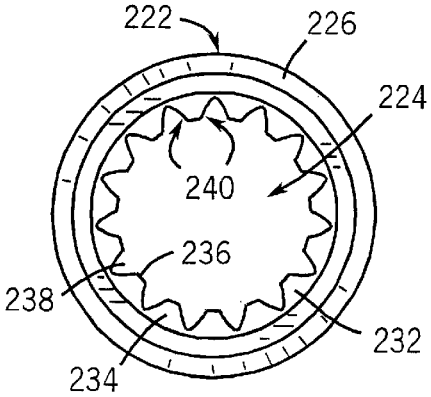
FIG. 5 is a right side elevation view of the drive coupler according to an exemplary embodiment.

Motor shaft portion 220 is disposed on a first end 202 of drive coupler 200 and is configured to engage motor shaft 22 as will be explained in further detail below. Motor shaft portion 220 includes a substantially cylindrical body 222. As shown in FIG. 5, motor shaft portion 220 further includes an internal cavity 224 disposed within cylindrical body 222 centered along major axis A—A. Internal cavity 224 disposed within cylindrical body 222 forms a substantially cylindrical wall 226 with wall thickness 228 as shown in FIG. 6. In an exemplary embodiment, wall thickness 228 is between 0.20 and 0.22 inches. However, in alternative embodiments, wall thickness 228 may be any thickness required to provide sufficient torsional rigidity or strength for a specified application. Wall 226 further includes a substantially cylindrical internal surface 230.

Motor shaft portion 220 further includes internal splines 232. Internal splines 232 are disposed circumferentially on internal surface 230, and extend parallel to major axis A—A.

As shown in FIG. 5, internal splines 232 include spline bodies 234, tips 236 and roots 238. Spline bodies 234 are bounded by side surfaces 240. Spline body 234 is further bounded, in a direction radially inward away from internal surface 230, by tip 236. Root 238 is an area shaped to receive a corresponding motor spline 26. Motor splines 26 fit within roots 238 in a slidable clearance fit. Root 238 and spline body 234 are alternatively circumferentially disposed on internal surface 230 thereby forming internal splines 232.

In an exemplary embodiment, internal splines 232 are formed by a process known as blind broaching. Internal splines 232 substantially conform with American Standard A.S.A. B5.15-1950.

As shown in FIGS. 1–3, motor shaft portion 220 is configured to engage motor shaft 22. In an exemplary embodiment, motor shaft 22 is provided with motor shaft splines 26 that are configured to engage internal splines 232. Motor shaft splines 26 engage internal splines 232 by sliding motor shaft portion 220 relative to motor shaft splines along major axis A—A. Once internal splines 232 engage motor shaft splines 26, relative axial rotation between motor shaft 22 and motor shaft portion 220 is prevented, thereby allowing the transmission of torque through drive coupler 200.

As shown in FIG. 3, pump shaft portion 250 is disposed on a second end 204 of drive coupler 200 and is configured to engage pump shaft 42 as will be explained below. Pump shaft portion 250 includes a substantially cylindrical body 252 having an outer surface 254.

Pump shaft portion 250 further includes external splines 262. External splines 262 are disposed circumferentially on outer surface 254, and extend parallel to major axis A—A as shown in FIG. 3.

Figure 4:
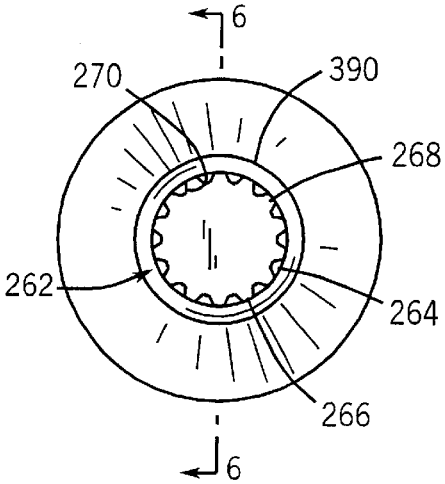
FIG. 4 is a left side elevation view of the drive coupler according to an exemplary embodiment.

As shown in FIG. 4, external splines 262 include spline bodies 264, tips 266 and roots 268. Spline bodies 264 are bounded by side surfaces 270. Spline bodies 264 are further bounded, in a direction radially outward away from outer surface 254, by tips 266. Roots 268 are an area shaped to receive a corresponding pump spline 46. Pump splines 46 fit within roots 238 in a slidable clearance fit. Roots 268 and spline bodies 264 are alternatively circumferentially disposed on outer surface 254 thereby forming external splines 262.

In an exemplary embodiment, external splines 262 are formed by a process known as hubbing. External splines 262 substantially conform with American Standard A.S.A. B5.15-1950.

As shown in FIG. 1, pump shaft portion 250 is configured to engage pump shaft 42. Pump shaft 42 includes pump socket 48 disposed on an end of pump shaft 42. In an exemplary embodiment, pump socket 48 is provided with pump shaft splines 46 that are configured to engage external splines 262. Pump splines 46 engage external splines 262 by sliding pump shaft portion 250 relative to pump shaft splines 46 along major axis A—A. Once external splines 262 engage pump shaft splines 46, relative axial rotation between pump shaft 42 and pump shaft portion 250 is prevented, thereby allowing the transmission of torque from drive coupler 200 to pump 40.

As shown in FIG. 3, reducing portion 280 is disposed between motor shaft portion 220 and pump shaft portion 250. Motor shaft portion 220 and pump shaft portion 250 are rigidly coupled together by reducing portion 280. In an exemplary embodiment shown in FIG. 6, motor shaft portion 220, pump shaft portion 250 and reducing portion 280 are integrally formed. Reducing portion 280 includes a first end 282 which has a diameter that substantially corresponds to the diameter of cylindrical body 222, and a second end 284 which has a diameter that substantially corresponds to the diameter of cylindrical body 252. Reducing portion 280 tapers in diameter from first end 282 to second end 284 forming a cone truncated shape. Alternatively, reducing portion 280 may be a series of successive discrete reducing steps, reducing in diameter from first end 282 to second end 284. Alternatively, reducing portion 280 may be a single step reduction between first end 282 and second end 284.

As. shown in FIG. 6, gasket 390 may alternatively be provided to substantially extend around pump shaft portion 250 and prevent any dirt, debris or contaminants from entering external splines 262.

In an alternative embodiments, internal splines 232 and external splines 262 may be substituted with various shaft coupling structures including a key-way, interference fit, threaded connector, welding, cross-bolts, pins, hex-shaped bodies, etc. As shown in FIG. 12, drive coupler 300 includes motor shaft key-way 332 disposed on motor shaft portion 320 to accept corresponding key 360 provided on motor shaft 370, and pump shaft key-way 362 disposed on pump shaft portion 350 to engage a key provided on a pump shaft (not shown).

Adapter 10 further includes collar 100 as shown in FIGS. 1, and 7–10. Collar 100 rigidly couples motor housing 24 to pump housing 44. Collar 100 is configured to couple a motor housing 24 having a first diameter, to a pump housing 44 having a second diameter wherein the first diameter is greater or lesser than the second diameter. In an exemplary embodiment, the first diameter of motor housing 24 is approximately 5.4 inches, and the second diameter of pump housing 44 is approximately 3.4 inches.

As shown in FIG. 2, collar 100 is a unitary body construction, made from an investment casting process. In an exemplary embodiment, collar 100 is constructed from stainless steel, but alternatively collar 100 may be constructed from other steel alloys, aluminum, brass, zinc, composite materials including fiberglass and carbon composites, etc.

Referring to FIGS. 7 and 9, collar 100 includes a motor flange 120, a pump flange 160, and a fluid inlet portion 140. Motor flange 120 includes an annular ring 122 having an outer diameter 124 and an inner diameter 126. In an exemplary embodiment, outer diameter 124 is 5.44 inches, and inner diameter 126 is between 3.76 inches. In alternative embodiments, outer diameter 124 and inner diameter 126 may be other sizes required to correspond to a motor body and pump body of alternative size.

Motor flange 120 is configured to be coupled to motor housing 24. As shown in FIG. 1, motor flange 120 is coupled to motor housing 24 by fasteners shown as bolts 128. Bolts 128 engage motor housing 24 through bolt holes 130 which are disposed circumferentially on annular ring 122.

Collar 100 further includes fluid inlet portion 140 which is rigidly coupled to motor flange 120 on a first end 142 of fluid inlet portion 140. As shown in FIG. 2, fluid inlet portion 140 and motor flange 120 are constructed from the same piece of material and thus integrally formed. In alternative embodiments, motor flange 120 and fluid inlet portion 140 may be rigidly coupled by various means including welding, threading, soldering, etc.

As shown in FIGS. 7 and 9, fluid inlet portion 140 includes a substantially cylindrical wall 144, having an inner cavity 146. Inner cavity 146 is suitably sized to allow for the free rotation of motor shaft 22, drive coupler 200, and pump shaft 42. In an exemplary embodiment, inner cavity 146 has a diameter of approximately 3.00 inches.

Fluid inlet portion 140 further includes apertures 148 circumferentially disposed in wall 144. Apertures 148 provide an open path in wall 144 through which fluid may flow. Fluid typically will flow from an area surrounding fluid inlet portion 140, through aperture 148, into pump 40, and out a pump exit (not shown).

In an alternative embodiment, as shown in FIG. 11, fluid inlet portion 140 further includes a screen 150. Screen 150 contains numerous perforations 156 which have smaller cross-sectional area than apertures 148. Screen 150 is a substantially flat material. Screen 150 is wrapped around wall 144 and covers apertures 148, thereby allowing screen 150 to filter out particles in the pumped fluid which would normally pass through apertures 148 and into pump 40, possibly damaging pump 40. Screen 150 is then affixed to wall 144 with a fastener shown as screw 152. Screw 152 is inserted through screen 150, and tightened into an aperture shown as screw hole 154, thereby securing screen 150 to wall 144.

Referring back to FIGS. 7 and 9, collar further includes pump flange 160 which is rigidly coupled to fluid inlet portion 140 on a second end 162 of fluid inlet portion 140. As shown in FIG. 2, pump flange 160 and fluid inlet portion 140 are constructed from the same piece of material and thus integrally formed. In alternative embodiments, pump flange 160 and fluid inlet portion 140 may be rigidly coupled by various means including welding, threading, soldering, etc.

Pump flange 160 is further configured to be coupled to pump housing 44. As shown in FIG. 1, pump flange 160 is coupled to pump housing 44 by fasteners shown as studs 164. Studs 164 in pump housing 44 engage pump flange 160 in bolt holes 166 which are disposed circumferentially on surface 168.

As shown from the disclosure above, adapter 10 includes several advantages. One such advantage is offering a kit which may be used to connect a motor and pump of choice. Furthermore, adapter 10 is configured to serve as a universal platform for adapting many different manufacturer's pumps to many different manufacturer's motors. Furthermore, adapter 10 allows for easy separation of motor 20 and pump 40, thereby simplifying maintenance and replacement of the fluid pumping system.

It is also important to note that the construction and arrangement of the elements of the adapter as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the preferred and other exemplary embodiments without departing from the spirit of the present inventions as expressed in the appended claims.

What is claimed is:

1. An adapter for coupling a motor to a pump, the adapter comprising:

a collar having a first and second end, the first end configured to be removably coupled to a motor housing and the second end configured to be removably coupled to a pump housing of differing size, wherein the collar forms an internal cavity;

a drive coupler disposed within the internal cavity, substantially coaxially aligned with the collar;

a motor shaft portion disposed on a first end of the drive coupler, the motor shaft portion being configured to engage a motor shaft; and a pump shaft portion disposed on a second end of the drive coupler, the pump shaft portion being configured to engage a pump shaft;

wherein the motor shaft portion and pump shaft portion are configured to engage a motor shaft and pump shaft of differing diameters.

2. The adapter of claim 1, wherein the collar further comprises at least one fluid inlet formed in the collar.

3. The adapter of claim 2, further comprising a screen substantially disposed over the at least one fluid inlet.

4. The adapter of claim 1, wherein the motor shaft portion is configured to engage a motor shaft from a 6" motor.

5. The adapter of claim 4, wherein the pump shaft portion is configured to engage a pump shaft from a 4" pump.

6. The adapter of claim 1, wherein the motor shaft portion is configured to engage a motor shaft from an 8" motor.

7. The adapter of claim 6, wherein the pump shaft portion is configured to engage a pump shaft from a 6" pump.

8. The adapter of claim 1, wherein the motor shaft portion further comprises:

a recess having an inner surface; and a plurality of splines disposed on the inner surface of the motor shaft portion wherein the splines are substantially parallel along a major axis of the pump shaft portion.

9. The adapter of claim 1, wherein the pump shaft portion has an outer surface and further comprising a plurality of splines disposed on the outer surface of the pump shaft portion, wherein the splines are substantially parallel along a major axis of the pump shaft portion.

10. The adapter of claim 1, further comprising a key-way disposed on an inner surface of the motor shaft portion.

11. The adapter of claim 1, wherein the pump shaft portion has an outer surface and further comprising a key-way disposed on the outer surface of the pump shaft portion.

12. The adapter of claim 1, wherein the motor shaft portion is a socket adapted to receive a motor shaft.

13. The adapter of claim 1, wherein the pump shaft portion is a shaft.

14. The adapter of claim 1, wherein the drive coupler is a unitary body.

15. The adapter of claim 1, wherein the pump shaft portion is configured to engage a pump shaft from a 4" pump.

16. The adapter of claim 1, wherein the pump shaft portion is configured to engage a pump shaft from a 6" pump.

17. A method of adapting a motor to a pump, the method comprising the steps of:

providing a collar having a first and second end, the first end configured to be removably coupled to a motor housing and the second end configured to be removably coupled to a pump housing of differing size, wherein the collar forms an internal cavity;

providing a drive coupler disposed within the internal cavity, substantially coaxially aligned with the collar;

providing a motor shaft portion disposed on a first end of the drive coupler, wherein the motor shaft portion is configured to engage a motor shaft; and providing a pump shaft portion disposed on a second end of the drive coupler, wherein the pump shaft portion is configured to engage a pump shaft;

wherein the motor shaft portion and pump shaft portion are configured to engage a motor shaft and pump shaft of differing diameters.

18. The method of claim 17, wherein providing the collar further comprises providing at least one fluid inlet formed in the collar.

19. The method of claim 18, further comprising providing a screen substantially disposed over the at least one fluid inlet.

20. The method of claim 17, wherein the motor shaft portion is configured to engage a motor shaft from a 6" motor.

21. The method of claim 20, wherein the pump shaft portion is configured to engage a pump shaft from a 4" pump.

22. The adapter of claim 17, wherein the motor shaft portion is configured to engage a motor shaft from an 8" motor.

23. The adapter of claim 22, wherein the pump shaft portion is configured to engage a pump shaft from a 6" pump.

24. The method of claim 17, wherein the motor shaft portion further comprises:

a recess having an inner surface; and providing a plurality of splines disposed on the inner surface of the motor shaft portion wherein the splines are substantially parallel along a major axis of the pump shaft portion.

25. The method of claim 17, wherein the pump shaft portion has an outer surface and further comprising providing a plurality of splines disposed on the outer surface of the pump shaft portion, wherein the splines are substantially parallel along a major axis of the pump shaft portion.

26. The method of claim 17, further comprising providing a key-way disposed on an inner surface of the motor shaft portion.

27. The method of claim 17, wherein the pump shaft portion has an outer surface and further comprising providing a key-way disposed on the outer surface of the pump shaft portion.

28. The method of claim 17, wherein the motor shaft portion is a socket adapted to receive a motor shaft.

29. The method of claim 17, wherein the pump shaft portion is a shaft.

30. The method of claim 17, wherein the pump shaft portion is configured to engage a pump shaft from a 4" pump.

31. The adapter of claim 17, wherein the pump shaft portion is configured to engage a pump shaft from a 6" pump.

32. An improved apparatus for rotatably coupling a motor shaft to an impeller shaft of differing size, the improvement comprising:

a collar having a first and second end, the first end configured to be removably coupled to a motor body and the second end configured to be removably coupled to a pump body, wherein the collar forms an internal cavity;

to a drive coupler disposed within the internal cavity, substantially coaxially aligned with the collar;

a motor shaft portion disposed on a first end of the drive coupler, wherein the motor shaft portion is configured to engage the motor shaft; and a pump shaft portion disposed on a second end of the drive coupler, wherein the pump shaft portion is configured to engage the pump shaft.

33. The apparatus of claim 32, wherein the collar further comprises at least one fluid inlet formed in the collar.

34. The apparatus of claim 33, further comprising a screen substantially disposed over the at least one fluid inlet.

35. The apparatus of claim 32, wherein the motor shaft portion is configured to engage a motor shaft from a 6" motor.

36. The apparatus of claim 32, wherein the pump shaft portion is configured to engage a pump shaft from a 4" pump.

37. The apparatus of claim 32, wherein the motor shaft portion is configured to engage a motor shaft from an 8" motor.

38. The apparatus of claim 32, wherein the pump shaft portion is configured to engage a pump shaft from a 6" pump.

39. The apparatus of claim 32, further comprising a plurality of splines disposed on an inner surface of the motor shaft portion wherein the splines are substantially parallel along a major axis of the pump shaft portion.

40. The apparatus of claim 32, further comprising a plurality of splines disposed on an outer surface of the pump shaft portion, wherein the splines are substantially parallel along a major axis of the pump shaft portion.

41. The apparatus of claim 32, further comprising a key-way disposed on an inner surface of the motor shaft portion.

42. The apparatus of claim 32, further comprising a key-way disposed on an outer surface of the pump shaft portion.

43. The apparatus of claim 32, wherein the motor shaft portion is a socket.

44. The apparatus of claim 32, wherein the pump shaft portion is a shaft.

45. The apparatus of claim 32, wherein the drive coupler is a unitary body.

46. An improved motor and pump assembly, a pump having pump shaft and a motor having a motor shaft, the improvement comprising:

a collar having a first end and a second end, the first end configured to be removably coupled to a motor body and the second end configured to be removably coupled to a pump body, wherein the collar forms an internal cavity;

a drive coupler disposed within the internal cavity, substantially coaxially aligned with the collar;

a motor shaft portion disposed on a first end of the drive coupler, wherein the motor shaft portion is configured to engage the motor shaft; and a pump shaft portion disposed on a second end of the drive coupler, wherein the pump shaft portion is configured to engage the pump shaft.

47. The improved motor and pump assembly of claim 46, wherein the collar further comprises at least one fluid inlet formed in the collar.

48. The improved motor and pump assembly of claim 47, further comprising a screen substantially disposed over the at least one fluid inlet.

49. The improved motor and pump assembly of claim 46, wherein the motor shaft portion is configured to engage a motor shaft from a 6" motor.

50. The improved motor and pump assembly of claim 46, wherein the pump shaft portion is configured to engage a pump shaft from a 4" pump.

51. The improved motor and pump assembly of claim 46, wherein the motor shaft portion is configured to engage a motor shaft from an 8" motor.

52. The improved motor and pump assembly of claim 46, wherein the pump shaft portion is configured to engage a pump shaft from a 6" pump.

53. The improved motor and pump assembly of claim 46, further comprising a plurality of splines disposed on an inner surface of the motor shaft portion wherein the splines are substantially parallel along a major axis of the pump shaft portion.

54. The improved motor and pump assembly of claim 46, further comprising a plurality of splines disposed on an outer surface of the pump shaft portion, wherein the splines are substantially parallel along a major axis of the pump shaft portion.

55. The improved motor and pump assembly of claim 46, further comprising a key-way disposed on an inner surface of the motor shaft portion.

56. The improved motor and pump assembly of claim 46, further comprising a key-way disposed on an outer surface of the pump shaft portion.

57. The improved motor and pump assembly of claim 46, wherein the motor shaft portion is a socket.

58. The improved motor and pump assembly of claim 46, wherein the pump shaft portion is a shaft.

59. The improved motor and pump assembly of claim 46, wherein the drive coupler is a unitary body.

* * * * *